US009447981B2

(12) United States Patent
Chan

(10) Patent No.: US 9,447,981 B2
(45) Date of Patent: Sep. 20, 2016

(54) COOLING FAN HAVING DETACHABLE HEATER

(71) Applicant: Perfect Union Co., Ltd., New Taipei (TW)

(72) Inventor: Ching Chan, New Taipei (TW)

(73) Assignee: PERFECT UNION CO., LTD., New Taipei (TW)

( * ) Notice: Subject to any disclaimer, the term of this patent is extended or adjusted under 35 U.S.C. 154(b) by 490 days.

(21) Appl. No.: 14/098,689

(22) Filed: Dec. 6, 2013

(65) Prior Publication Data

US 2015/0159891 A1 Jun. 11, 2015

(51) Int. Cl.

| | |
|---|---|
| ***F24H 3/04*** | (2006.01) |
| ***F24F 7/007*** | (2006.01) |
| ***F24F 3/16*** | (2006.01) |
| ***F24H 9/00*** | (2006.01) |
| ***F24H 9/02*** | (2006.01) |
| *F24H 9/20* | (2006.01) |
| *H05B 1/02* | (2006.01) |
| *F24F 1/00* | (2011.01) |

(52) U.S. Cl.

CPC ..... *F24F 7/007* (2013.01); *F24F 3/1603* (2013.01); *F24H 3/0417* (2013.01); *F24H 9/0063* (2013.01); *F24H 9/02* (2013.01); *F24F 2001/0096* (2013.01); *F24H 9/2071* (2013.01); *F24H 2250/02* (2013.01); *H05B 1/0275* (2013.01); *H05B 1/0283* (2013.01)

(58) Field of Classification Search

CPC ..... F04D 25/08; F04D 25/12; F04D 25/14; F04D 29/582; F04D 29/5853; F24H 9/02; F24H 9/0063; F24H 2250/02; F24H 3/0405; F24H 3/04; F24H 3/0411; F24H 9/2071; F24H 3/0417; H05B 1/0283; H05B 1/0275; F24F 7/007; F24F 3/1603; F24F 2001/0096

USPC ..... 415/146, 175–177; 392/360, 361, 365, 392/367, 368

See application file for complete search history.

(56) References Cited

U.S. PATENT DOCUMENTS

| | | | | |
|---|---|---|---|---|
| 5,443,364 | A * | 8/1995 | Mistry | F04D 29/626 403/326 |
| 7,894,712 | B2 * | 2/2011 | Karlsson | F24H 3/0411 392/385 |
| 8,007,228 | B2 * | 8/2011 | Wang | F04D 25/0613 415/146 |
| 2010/0178041 | A1 * | 7/2010 | Rookstool | F24H 3/0417 392/365 |
| 2012/0141264 | A1 * | 6/2012 | Cui | F04D 25/08 415/206 |
| 2012/0216985 | A1 * | 8/2012 | Tai | F24H 9/0057 165/59 |

* cited by examiner

*Primary Examiner* — Christopher Verdier

(74) *Attorney, Agent, or Firm* — Jackson IPG PLLC; Demian K. Jackson

(57) ABSTRACT

A combination cooling and heating device is provided with a cooling fan including an outlet including a mouth; and a heater including a mouth member complimentarily connected to the mouth of the outlet of the cooling fan, an indicator, a shell member including heating elements, a blade assembly, a micro switch, a spring biased trigger member, a front louver, and a frame secured to both the louver and the shell member. The trigger member is attached to the micro switch. The blade assembly is rotatably secured to the trigger member. In a heating operation, the fan activates to produce airflow which rotates the blade assembly, the blade assembly rotates to pull the trigger member, and the trigger member turns on the micro switch which activates the heating elements, thereby taking heat generated by the heating elements out of the louver.

5 Claims, 5 Drawing Sheets

COOLING FAN HAVING DETACHABLE HEATER

BACKGROUND OF THE INVENTION

1. Field of the Invention

The invention relates to combination fan and heater and more particularly to a cooling fan having a detachable heater.

2. Description of Related Art

A cooling fan is used to create airflow. The fan is comprised of a rotating arrangement of blades which act on the air.

A fan heater is a heater that works by using a fan to pass air over a heating element. This heats the air, which then leaves the heater, warming up the surrounding room. They can heat an enclosed space such as a room faster than a heater without fan.

There is a combination fan and heater capable of providing a cooling or heated flow of air at various desired temperatures and airflow speeds. However, the fan and the heater are an integral unit. Thus, a selective use of one of the fan and the heater is not possible.

For the sake of saving space, it is desirable to have a device which can be used as a cooling fan during summer months and can be detachably fastened with a heater to be used during winter months.

Thus, the need for improvement still exists.

SUMMARY OF THE INVENTION

It is therefore one object of the invention to provide a combination cooling and heating device comprising a cooling fan comprising an outlet including a mouth; and a heater comprising a mouth member complimentarily connected to the mouth of the outlet of the cooling fan, an indicator, a shell member including a plurality of internal heating elements, a blade assembly, a micro switch, a spring biased trigger member, a front louver, and a frame secured to both the louver and the shell member; wherein the indicator and the heating elements are electrically connected to a power cord, the trigger member is attached to the micro switch, and the blade assembly is rotatably secured to the trigger member; and wherein in a heating operation, the fan activates to produce airflow which rotates the blade assembly, the blade assembly rotates to pull the spring biased trigger member, the trigger member turns on the micro switch which activates the heating elements, thereby taking heat generated by the heating elements out of the louver.

The above and other objects, features and advantages of the invention will become apparent from the following detailed description taken with the accompanying drawings.

DETAILED DESCRIPTION OF THE INVENTION

Figure 1:
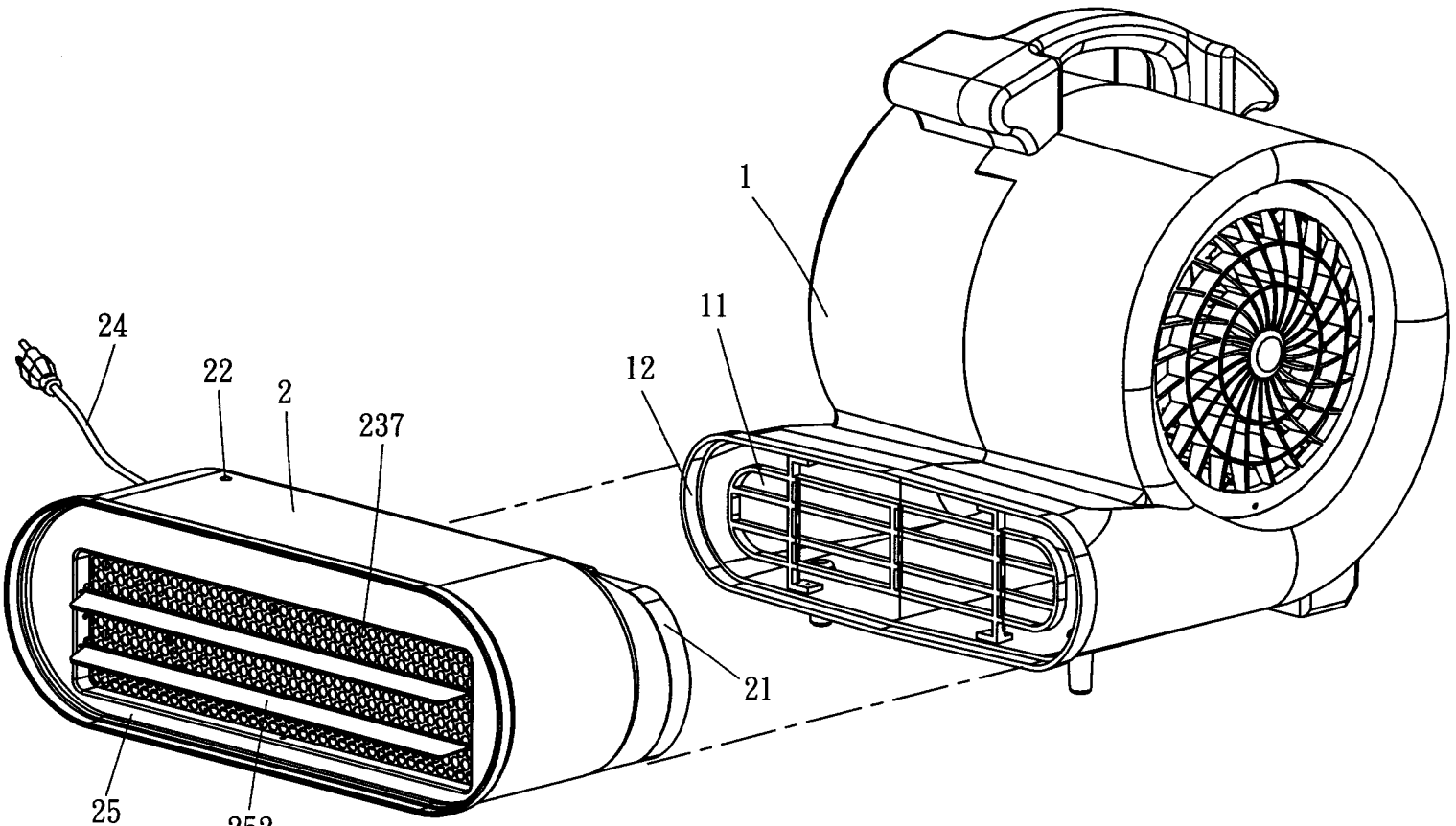
FIG. 1 is an exploded perspective view of a combination fan and heater according to the invention.
Figure 2:
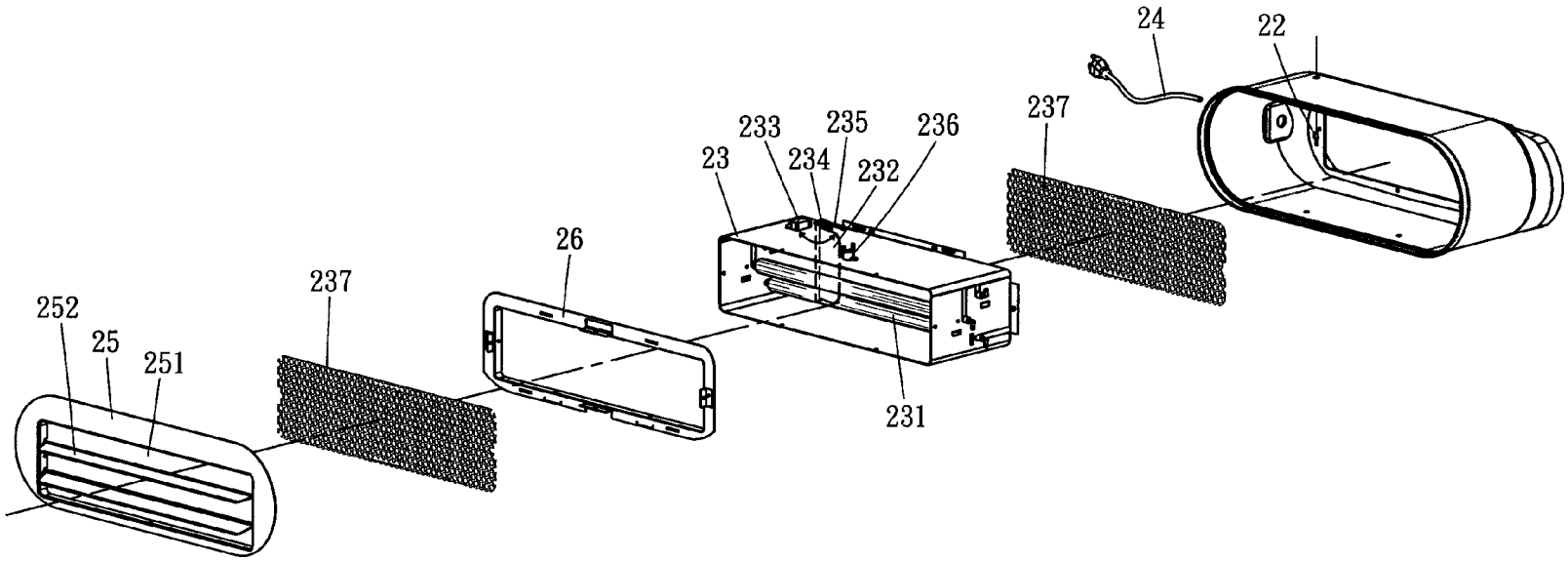
FIG. 2 is an exploded view of the heater.
Figure 4:
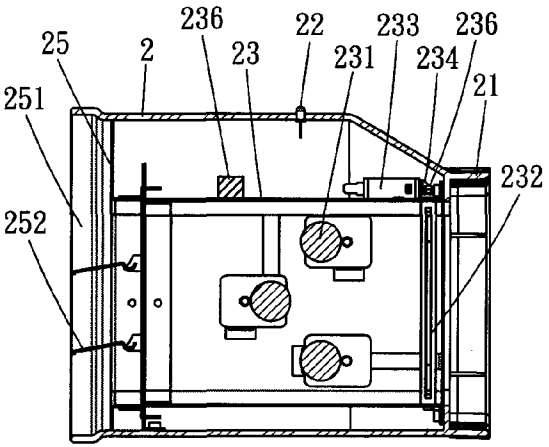
FIG. 4 is a sectional view taken along line 4-4 of FIG. 3.
Figure 3:
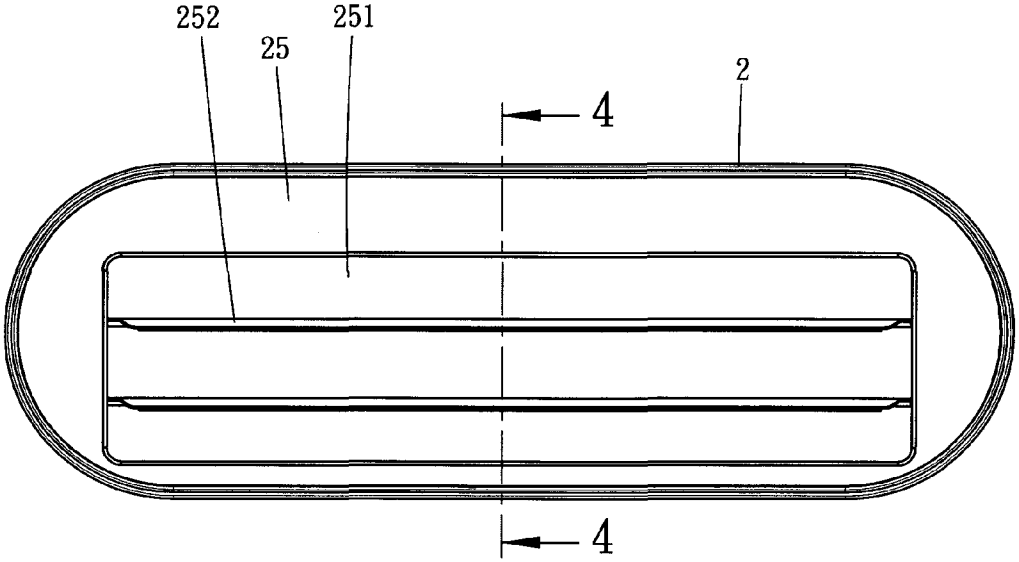
FIG. 3 is a front view of the heater.

Referring to FIGS. 1 to 6, a combination fan and heater in accordance with the invention comprises the following components as discussed in detail below.

A fan 1 and a heater 2 are provided. The fan 1 comprises an outlet 11 having a mouth 12 complimentarily connected to a rear mouth 21 of the heater 2. The heater 2 comprises an indicator 22 on a top, a shell member 23 made of metal and having a plurality of heating elements 231, a blade assembly 232, a micro switch 233, a trigger member 234, a spring 235 attached to the trigger member 234, and an overheat cutout 236. The indicator 22, the heating elements 231, and the overheat cutout 236 are electrically connected to a power cord 24. The trigger member 234 is attached to the micro switch 233. The blade assembly 232 is rotatably secured to the trigger member 234.

The heater 2 has an oval longitudinal section when viewing from the front or rear end. The heater 2 comprises, from front to rear, a louver 25 including a plurality of pivotal slats 252 (i.e., being angle adjustable) and a plurality of openings 251 each adjacent to the slat 252; a rectangular frame 26 secured to both the louver 25 and the shell member 23, and two filters 237 in which one filter 237 is mounted on the frame 26 rearward of the louver 25 and the other filter 237 is mounted in a rear end of the shell member 23.

In a heating operation, the fan 1 activates to produce airflow which passes the outlet 11. And in turn, the blade assembly 232 rotates to pull the spring biased trigger member 234. The trigger member 234 then turns on the micro switch 233 which in turn activates the heating elements 231. As a result, heat generated by the heating elements 231 is taken out of the openings 251.

The heating operation will be stopped when the fan 1 is deactivated. The blade assembly 232 stops rotation. And in turn, the trigger member 234 returns to its original position. And in turn, the micro switch 233 is open to stop supplying electricity to the heating elements 231.

Figure 5:
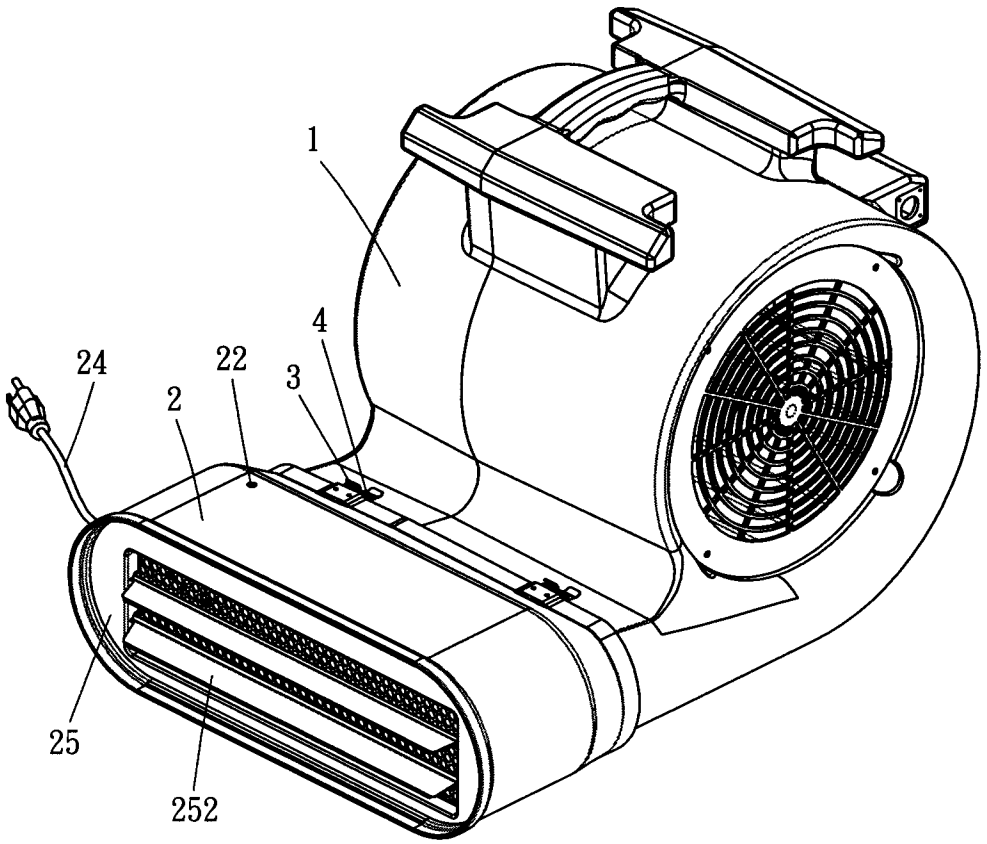
FIG. 5 is a perspective view of the combination fan and heater with hooks and eyes provided for quick fastening or separation.
Figure 6:
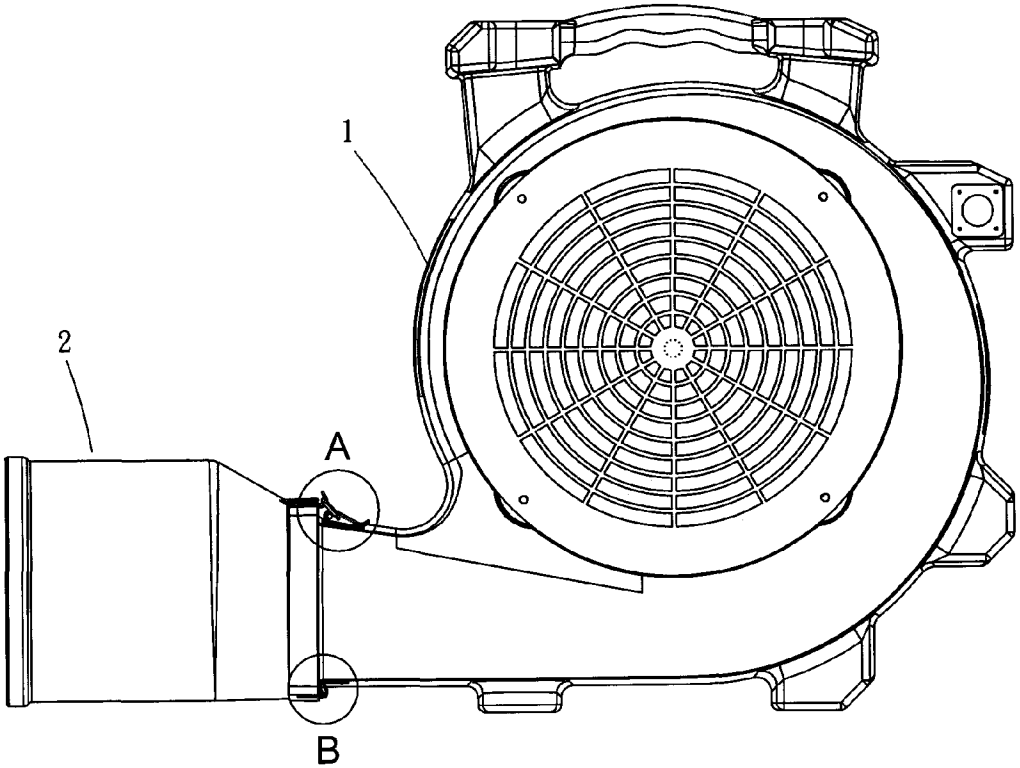
FIG. 6 is a side elevation of FIG. 5.
Figure 6A:
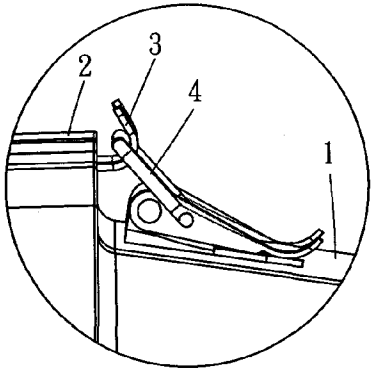
FIG. 6A is an enlarged view of portion A of FIG. 6.
Figure 6B:
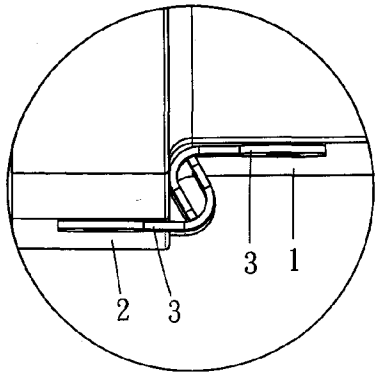
FIG. 6B is an enlarged view of portion B of FIG. 6.

As shown in FIGS. 5 and 6 specifically, hooks 3 and eyes 4 are provided on top or bottom of a joining portion of the fan 1 and the heater 2 so as to carry out a quick fastening or separation of the fan 1 and the heater 2.

While the invention has been described in terms of preferred embodiments, those skilled in the art will recognize that the invention can be practiced with modifications within the spirit and scope of the appended claims.

What is claimed is:

1. A combination cooling and heating device comprising:

a cooling fan comprising an outlet including a mouth; and a heater comprising a mouth member complimentarily connected to the mouth of the outlet of the cooling fan, an indicator, a shell member including a plurality of internal heating elements, a blade assembly, a micro switch, a spring biased trigger member, a front louver, and a frame secured to both the louver and the shell member;

wherein the indicator and the heating elements are electrically connected to a power cord, the trigger member is attached to the micro switch, and the blade assembly is rotatably secured to the trigger member; and wherein in a heating operation, the fan activates to produce airflow which rotates the blade assembly, the blade assembly rotates to pull the spring biased trigger member, and the trigger member turns on the micro switch which activates the heating elements, thereby taking heat generated by the heating elements out of the louver.

2. The combination cooling and heating device of claim 1, further comprising an overheat cutout on the shell member, the overheat cutout being electrically connected to the power cord.

3. The combination cooling and heating device of claim 1, further comprising two filters wherein one filter is disposed on the frame and the other filter is mounted in a rear end of the shell member.

4. The combination cooling and heating device of claim 1, wherein the louver comprises a plurality of pivotal, horizontal slats.

5. The combination cooling and heating device of claim 1, further comprising a plurality of hooks and eyes provided on top or bottom of a joining portion of the fan and the heater.

* * * * *